US006610950B1

(12) United States Patent
Kamio et al.

(10) Patent No.: US 6,610,950 B1
(45) Date of Patent: Aug. 26, 2003

(54) PUSH SWITCH

(75) Inventors: Kenji Kamio, Okayama (JP); Hisashi Watanabe, Okayama (JP); Koji Sako, Okayama (JP); Takashi Tomago, Okayama (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 0 days.

(21) Appl. No.: 09/857,470

(22) PCT Filed: Oct. 2, 2000

(86) PCT No.: PCT/JP00/06828

§ 371 (c)(1),
(2), (4) Date: Aug. 8, 2001

(87) PCT Pub. No.: WO01/26125

PCT Pub. Date: Apr. 12, 2001

(30) Foreign Application Priority Data

Oct. 6, 1999 (JP) ..... 11-285558

(51) Int. Cl.[7] ..... H01H 5/18
(52) U.S. Cl. ..... 200/406; 200/576
(58) Field of Search ..... 200/406, 505, 200/329, 510–520, 330, 341

(56) References Cited

U.S. PATENT DOCUMENTS 3,941,964 A 3/1976 Yoder
3,996,429 A * 12/1976 Chu et al. ..... 200/1 R
4,412,113 A * 10/1983 Mitsugi et al. ..... 200/242
4,794,215 A 12/1988 Sawada et al.
4,843,197 A * 6/1989 Kojima et al. ..... 200/302.2
4,916,275 A 4/1990 Almond
4,939,271 A 7/1990 Markle
5,595,288 A 1/1997 Matsui et al.
5,898,147 A * 4/1999 Domzalski et al. ..... 200/1 B
6,140,596 A * 10/2000 Tsay ..... 200/406
6,180,903 B1 * 1/2001 Chen ..... 441/124

FOREIGN PATENT DOCUMENTS

| | | |
|---|---|---|
| JP | 54-49573 | 4/1979 |
| JP | 61-63734 | 4/1986 |
| JP | 3-91629 | 9/1991 |
| JP | 5190053 | 7/1993 |
| JP | 9-120737 | 5/1997 |
| JP | 9-120738 | 5/1997 |
| JP | 11-126541 | 5/1999 |
| JP | 11-232962 | 8/1999 |

* cited by examiner

*Primary Examiner*—Elvin Enad
*Assistant Examiner*—Lisa Klaus
(74) *Attorney, Agent, or Firm*—Wenderoth, Lind & Ponack, L.L.P.

(57) ABSTRACT

Fixed contacts 11, 12, 13 and 14 are provided on the bottom face 10B of recess 10A in switch housing 10. Two contact-receptors 10C, 10D are disposed at corners so as to confront each other on the bottom face 10B. Outer rim 15B of domed movable contact 15 made of thin metal plate and bowed upwardly is placed on the receptors so that a lower face of top 15A of movable contact 15 faces fixed contacts 11, 12, 13 and 14. Flexible film 16 is fixed so that film 16 covers recess 10A and accommodates domed movable contact 15.

15 Claims, 10 Drawing Sheets

PUSH SWITCH

FIELD OF THE INVENTION

The present invention relates to a push switch used in portable electronic devices including a cellular phone, a headphone stereo cassette and the like.

BACKGROUND ART

Recently, portable electronic devices have been downsized and thinned remarkably. Thus, the demand for the push switches used in these portable electronic devices to also be downsized and thinned has been strong.

A conventional push switch is described hereinafter with reference to FIGS. 14 and 15. FIG. 14 is a front cross sectional view of the conventional push switch. FIG. 15 is a plan view of a switch housing illustrating a fixed contact of the switch shown in FIG. 14.

The conventional push switch shown in FIGS. 14 and 15 comprises a switch housing 1 shaped as a box and made of insulated resin, a central fixed contact 2 disposed at the center of a bottom face of a recess in switch housing 1, coupling terminals 2A, 2B extending from the central fixed contact 2 to the outside of switch housing 1, an outside fixed contact 3 disposed on a periphery of the recess of switch housing 1, coupling terminals 3A, 3B extending from the outside fixed contact 3 to the outside of switch housing 1, a domed movable contact 4 bowed upwardly, made of a thin metallic plate and accommodated in the recess so that its outer rim is placed on outside-fixed-contact 3 of switch housing 1, and a flexible film 5 covering the recess which accommodates domed-movable contact 4.

Coupling, terminals 2A, 2B, 3A and 3B are insert-molded with switch housing 1 and led outside the housing 1. Film 5 has bonding agent 5A on its lower face. Film 5 adheres to upper face of the periphery of the recess due to bonding agent 5A. A small and thin push switch is thus structured.

An operation of the push switch structured above is described hereinafter. First, film 5 is depressed downwardly, then top section 4A of domed movable contact 4 is bent and elastically deformed. This elastic deformation brings top section 4A into contact with central fixed contact 2. Therefore, outside fixed contact 3 becomes electrically connected to central fixed contact 2 via domed movable contact 4. In other words, the push switch is turned on. When the depressing force is removed, movable contact 4 restores itself to an original place shown in FIG. 14 due to its elastic restoring force (i.e., the push switch is turned off).

However, in the conventional push switch discussed above, coupling terminals 2A, 2B are electrically connected to the central fixed contact, and coupling terminal 3A, 3B are electrically connected to the outside fixed contact. These four terminals 2A, 2B, 3A and 3B are led outside switch housing 1. When the conventional push switch is mounted onto a printed wired board, a wiring for the push switch must be coupled to at least one of terminals 2A and 2B. In the same manner, the wiring also must be coupled to at least one of terminals 3A and 3B. Thus, the circuit wiring is routed with some restrictions in a design stage. As a result, when a-printed-wiring-circuit including the conventional push switch is designed, a subject electronic device to be designed encounters restrictions of downsizing and thinning.

SUMMARY OF THE INVENTION

The present invention addresses the problem discussed above, and aims to provide a push switch which allows increased flexibility in the design of a printed wiring board. As a result, restrictions in the design of a thin and compact electronic device can be reduced.

To achieve the object, the push switch of the present invention includes at least three fixed contacts disposed electrically independently on a bottom face at a recess of a switch housing shaped as a box and made of insulated resin. Coupling terminals extend from these fixed contacts and are led out externally, and contact-receptors are provided at corners of the bottom face of the recess. A domed movable contact has a center section which is bowed upwardly, and the movable contact is placed on the contact-receptors and accommodated in the recess of the switch housing, and a lid covers the recess and is fixed to the switch housing.

When the push switch structured above is depressed, the domed movable contact is reversed and brought into contact with the plural fixed contacts simultaneously. Therefore, two random coupling terminals led out from the plural fixed contacts can have a switch function. As a result, a push switch, which allows increased flexibility in the design of a printed wiring board and reduces restrictions in the design of a thin and compact electronic device, is obtainable.

DESCRIPTION OF THE INVENTION

Exemplary embodiments of the present invention are demonstrated hereinafter with reference to the accompanying drawings FIG. 1 through FIG. 13.

EXEMPLARY EMBODIMENT 1

Figure 1:
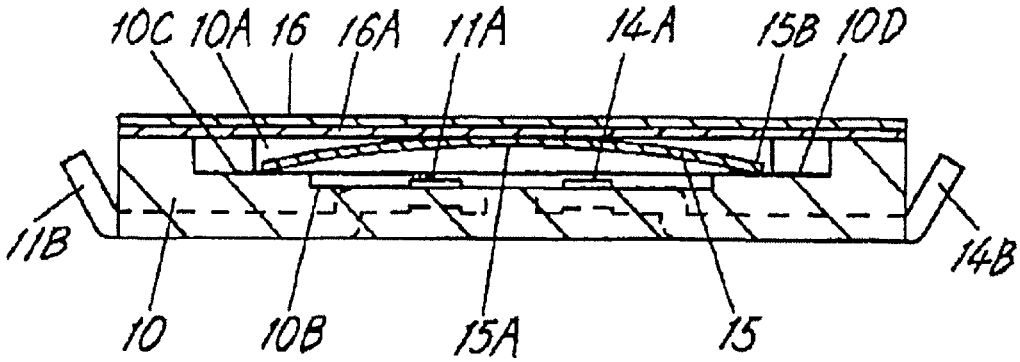
FIG. 1 is a front cross sectional view of a push switch in accordance with a first exemplary embodiment of the present invention.
Figure 2:
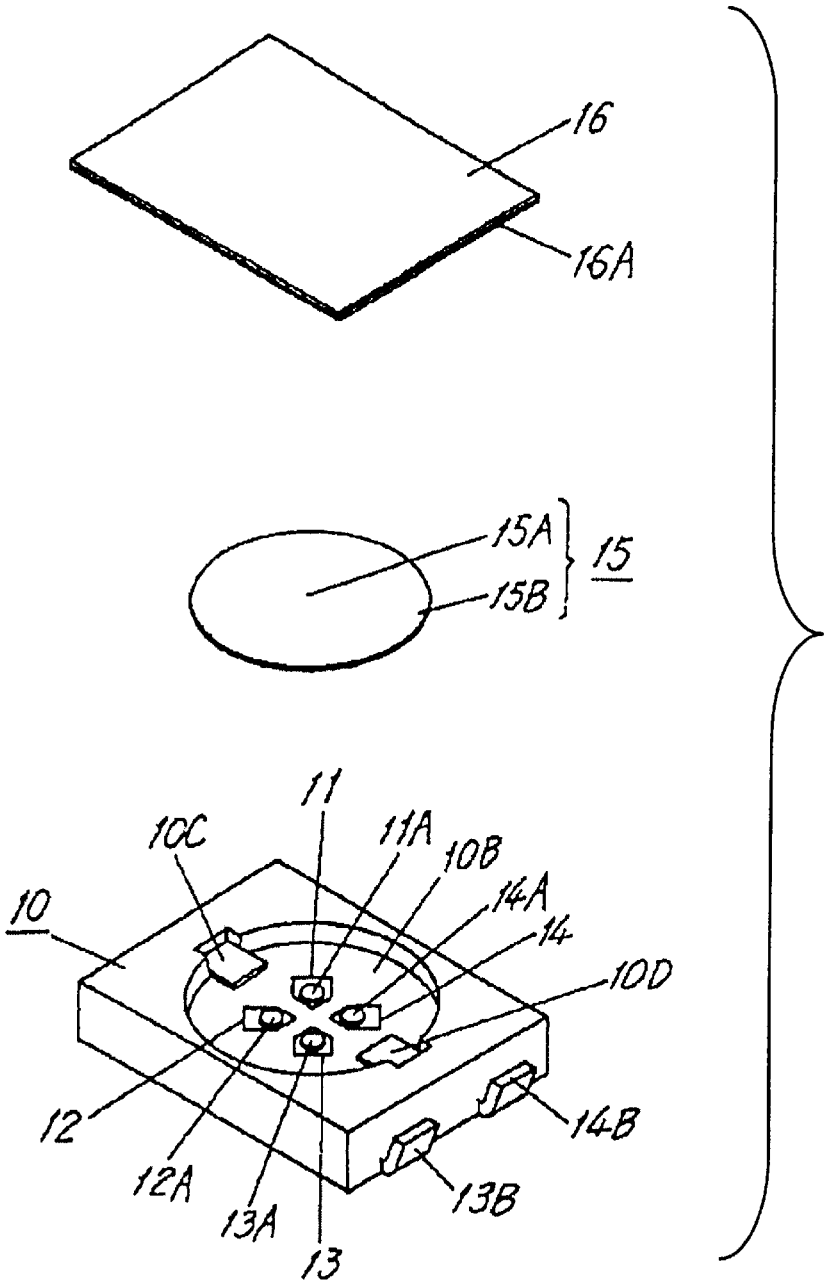
FIG. 2 is an exploded perspective view of the push switch shown in FIG. 1.

FIG. 1 is a front cross sectional view of a push switch in accordance with the first exemplary embodiment of the present invention. FIG. 2 is an exploded perspective view of the push switch shown in FIG. 1. The push switch in accordance with the first exemplary embodiment includes a switch housing 10 open upwardly and made of insulated resin. Four fixed contacts 11, 12, 13 and 14 are disposed at a center section on bottom face 10B of recess 10A of switch housing 10. Two contact-receptors 10C, 10D form a step and are disposed on bottom face 10B of switch housing 10 so that the two receptors face each other. Domed movable contact 15 is bowed upwardly, and is made of thin metallic plate and accommodated in the recess 10A of switch case 10 and placed on contact-receptors 10C, 10D. A cover made of flexible film 16 covers recess 10A of the switch housing.

Figure 3:
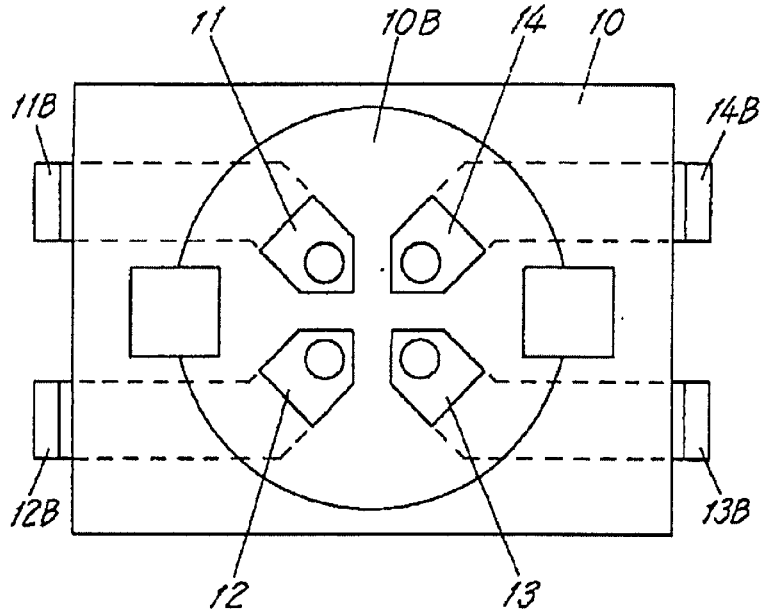
FIG. 3 is a plan view of a switch housing illustrating fixed contacts of the push switch shown in FIG. 1.

The four fixed contacts 11, 12, 13 and 14 have contact points 11A, 12A, 13A and 14A whose upper faces protrude. Outer rim 15B of movable contact 15 is placed on receptors 10C, 10D, which form step and are disposed on bottom face 10B of switch housing 10 so as to face each other. Contact-receptors 10C, 10D are formed so as to avoid (be separated from) the four fixed contacts (11, 12, 13 and 14). The lower face of top section 15A of domed movable contact 15 faces four fixed contacts 11, 12, 13 and 14. Flexible film 16 has bonding agent 16A on its lower face, and is bonded to an upper face of switch housing 10 due to bonding agent 16A. From respective fixed contacts 11, 12, 13 and 14, coupling terminals 11B, 12B, 13B and 14B are led to the outside of switch housing 10. As shown in FIG. 3, respective fixed contacts 11, 12, 13 and 14 are fixed to bottom face 10B of switch housing 10 by insert-molding, and they are electrically independent (i.e., not electrically connected). These fixed contacts and coupling terminals are made by punching the same thin metallic plate. The punched fixed contacts and the coupling terminals are insert-molded when the switch housing is molded with insulated resin. As a result, the fixed contacts and the coupling terminals can be made from one material, so that materials and processes are streamlined on the push switch, and the switch housing can be manufactured efficiently.

An operation of the push switch structured as discussed above is demonstrated hereinafter. When flexible film 16 is depressed downwardly, top section 15A of domed movable contact 15 is elastically deformed. This deformation brings the lower face of top section 15A into contact with the four contact sections 11A, 12A, 13A and 14A. When the depression is stopped, movable contact 15 restores itself to its original form by its own restoring force (i.e., the push switch is turned off).

Through the depressing operation, four fixed contacts 11, 12, 13 and 14, electrically independent of each other, are electrically connected to each other simultaneously via domed movable contact 15, which is made of electrically-conductive metal. When the depressing is stopped, respective fixed contacts 11, 12, 13 and 14 are no longer electrically connected to each other simultaneously. As a result, two terminals randomly selected from coupling terminals 11B, 12B, 13B and 14B extended from each fixed contact 11, 12, 13 and 14 function as a switch. In other words, when film 16 is depressed downwardly, the selected two terminals are electrically connected, and when the depressing is stopped, the two selected terminals are not electrically connected.

The push switch used in this first embodiment can have a switch function between the two coupling terminals led out from two fixed contacts randomly selected from the plural fixed contacts. Therefore, an arbitrary combination of the coupling terminals can increase the flexibility in the design of a printed wiring board.

Since respective terminals are independent of each other, another switch can be formed between one terminal and the others. This is another advantage of this embodiment.

The fixed contacts in this embodiment are described together with a protruded contact section of the domed movable contact. However, as shown in FIG. 4, fixed contacts 21, 22, 23 and 24 embossed on bottom face 20B of recess 20A of switch housing 20 can be brought into contact with the domed movable contact in a stable manner.

Figure 5:
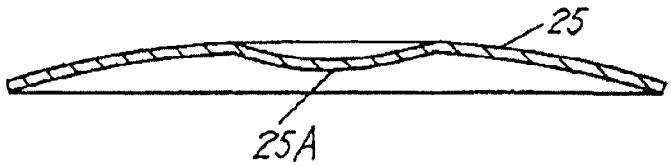
FIG. 5 is a front cross sectional view of another form of a domed movable contact of the push switch shown in FIG. 1.

Further as shown in FIG. 5, domed movable contact 25 can have a protrusion 25A on its lower face, and the protrusion faces the fixed contacts. This protrusion 25A allows the domed movable contact to be brought into contact with respective fixed contacts in a stable manner.

Figure 4:
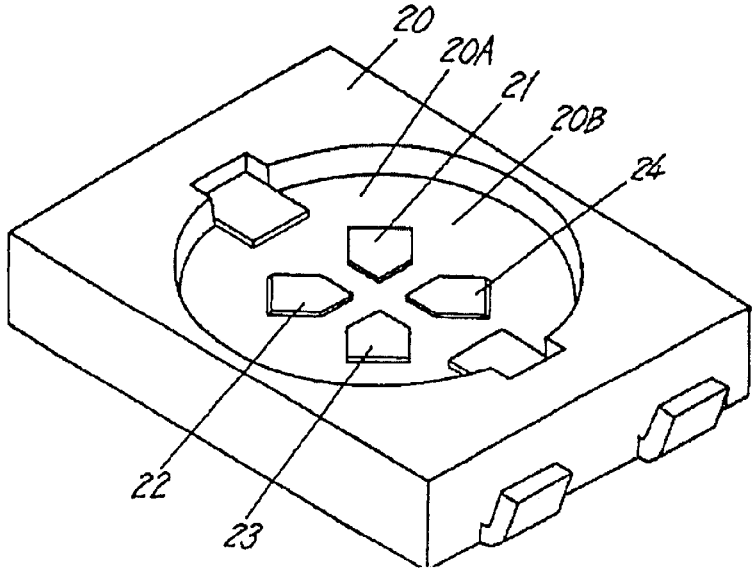
FIG. 4 is a perspective view of the switch housing illustrating another shape of the fixed contacts of the push switch shown in FIG. 1.

The push switch shown in FIGS. 3, 4 and used in the first embodiment is described with four fixed contacts. When a switch has three fixed contacts, two terminals out of three extended from the respective contacts are randomly selected, and those two terminals can function as a switch. When a switch has five or more fixed contacts, two terminals randomly selected out of the terminals extended from the respective contacts can function as a switch. Therefore, an arbitrary combination of respective terminals can increase the amount of flexibility in the design of a printed wiring board.

EXEMPLARY EMBODIMENT 2

Figure 6:
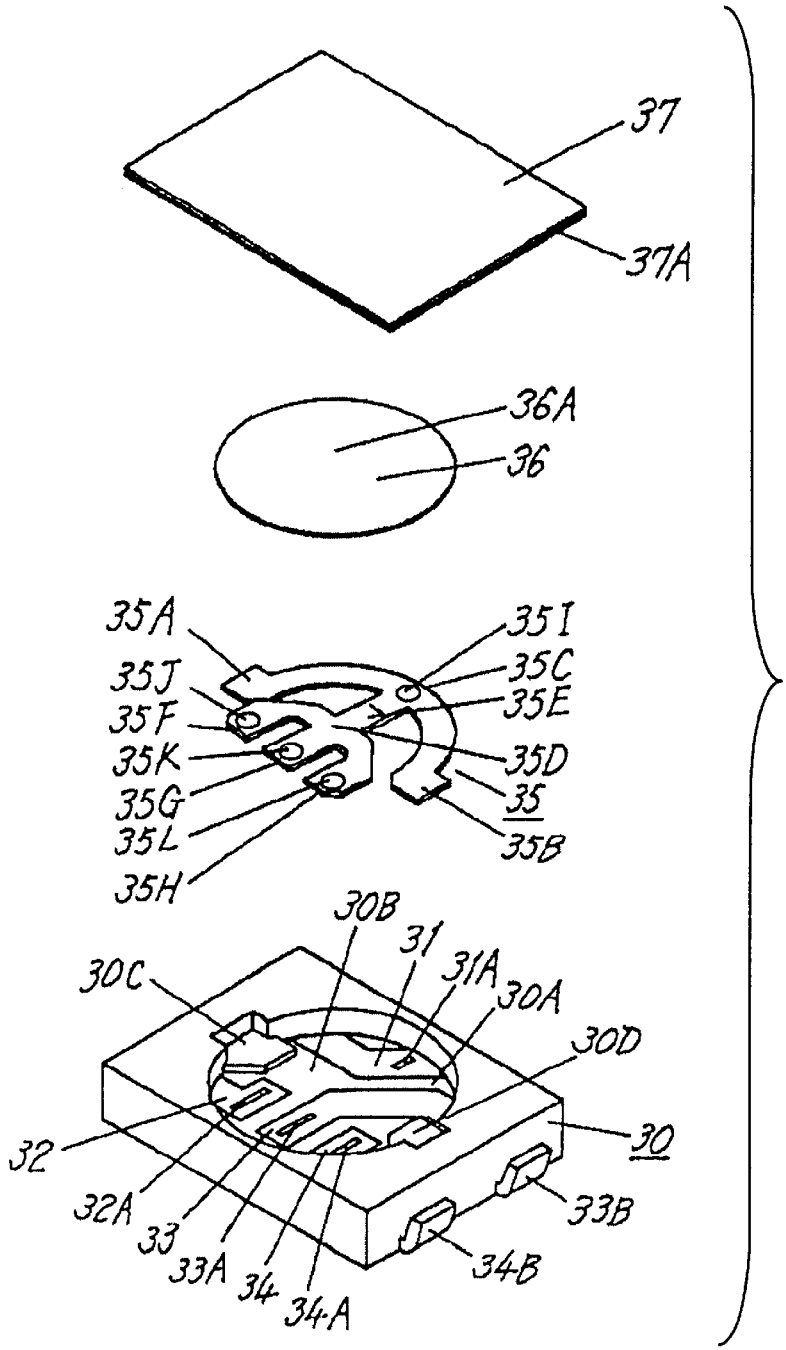
FIG. 6 is an exploded perspective view of a push switch in accordance with a second exemplary embodiment of the present invention.
Figure 7:
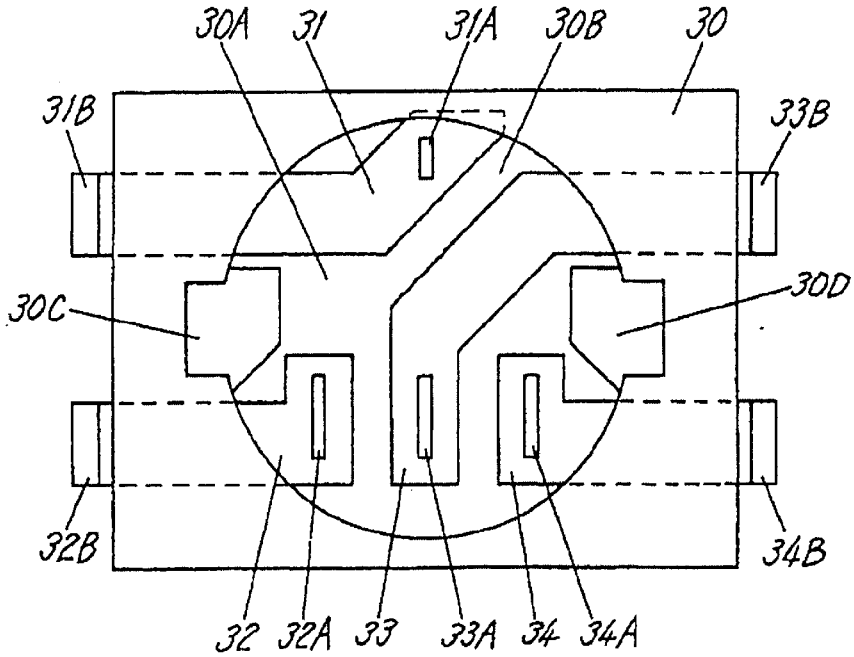
FIG. 7 is a plan view of a switch housing illustrating fixed contacts of the push switch shown in FIG. 6.

FIG. 6 is an exploded perspective view of a push switch in accordance with the second exemplary embodiment of the present invention. FIG. 7 is a plan view of a switch housing illustrating fixed contacts of the push switch shown in FIG. 6. The push switch shown in FIGS. 6 and 7 used in the second embodiment includes a switch housing 30 open upwardly, and four fixed contacts 31, 32, 33 and 34 are disposed electrically independently on bottom face 30B of recess 30A in switch housing 30. A contact slip 35 approximately shaped as a fork and made of elastic thin metallic plate, is accommodated in recess 30A. A domed movable contact 36 is bowed upwardly, and is made of elastic thin metallic plate and placed on contact slip 35. A cover formed of flexible film 37 covers domed movable contact 36.

Four fixed contacts 31, 32, 33 and 34 are disposed electrically independently (i.e., not electrically connected) on bottom face 30B of the recess and insert-molded. The four contacts have protrudedly processed contact sections 31A, 32A, 33A and 34A on their upper faces. Two contact-receptors 30C, 30D forming a step are disposed on bottom face 30B so that they face each other. Receptors 30C and 30D are formed to avoid (i.e., be separated from) the four fixed contacts 31, 32, 33 and 34. Coupling terminals 31B, 32B, 33B and 34B extending from respective fixed contacts are led out outside switch housing 30. Flexible film 37 has bonding agent 37A on its lower face, and film 37 covers recess 30A and is fixed to the upper face of housing 30 due to bonding agent 37A.

As shown in FIG. 7, three contact sections 32A, 33A and 34A out of four fixed contacts are placed in one side of bottom face 30B and aligned. The remaining contact section 31A is located on the other side of the bottom face 30B opposite the three contact sections.

Figure 8:
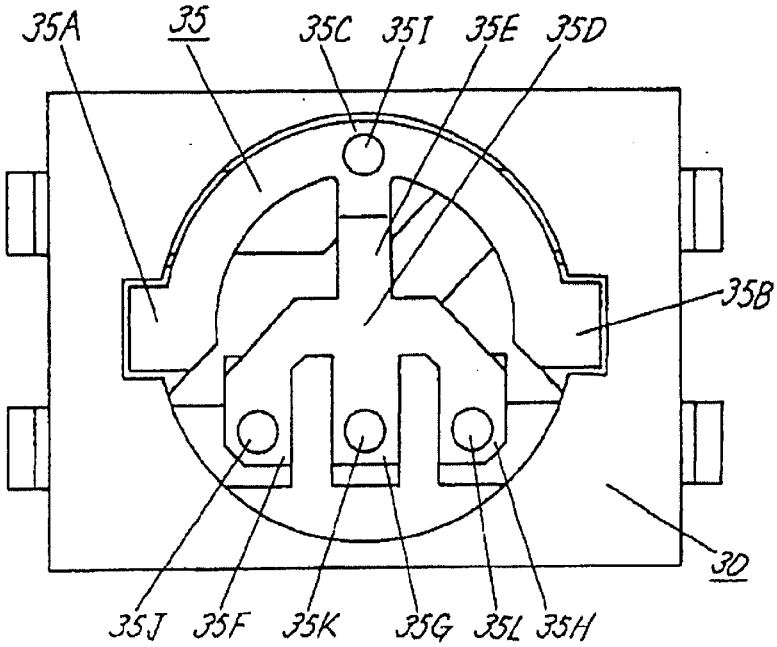
FIG. 8 is a plan view illustrating a contact slip of the push switch shown in FIG. 6 in the switch housing.

Contact slip 35 shown in FIG. 8, a plan view, is accommodated in switch housing 30. Contact slip 35 includes two supporting sections 35A and 35B, both shaped as arcs and extending along both sides of the inner rim of recess 30A, a center section 35C including contact section 35I formed between two supporting sections 35A and 35B, an arm 35E extending from center section 35C, moderately curved upwardly and having three-sectioned fork 35D on its end, and contact sections 35J, 35K and 35L downwardly protruding from tips 35F, 35G and 35H extended from three-sectioned fork 35D.

Two supporting sections 35A and 35B are placed above two contact-receptors 30C and 30D. Four contact sections 35I, 35J, 35K and 35L are placed corresponding to contact sections 31A, 32A, 33A and 34A of fixed contacts 31, 32, 33 and 34. Normally, contact sections 35J, 35K and 35L are spaced a given distance apart from contact sections 32A, 33A and 34A, and face respectively toward each other. On the other hand, contact section 35I is disposed so that it is always brought into contact with contact section 31A of fixed contact 31.

An operation of the push switch structured above and used in the second embodiment is demonstrated hereinafter.

Flexible film 37 is depressed downwardly, then domed movable contact 36 is bent and elastically deformed. This deformation allows top section 36A to depress three-sectioned fork 35D of contact section 35. This depression bends arm 35E downwardly. This downward bending allows contact sections 35J, 35K and 35L provided on tips 35F, 35G and 35H to be brought into contact with corresponding contact sections 32A, 33A and 34A. Then this contact allows respective fixed contacts 31, 32, 33 and 34, which are electrically independent, to be electrically connected to each other simultaneously via contact slip 35.

According to the second embodiment, the domed movable contact is elastically deformed, so that the respective contact sections (35F, 35G and 35H) of the three-sectioned fork of the arm end are brought into contact with the corresponding contact sections of the fixed contacts. In other words, top section 36A of the movable contact elastically deformed is brought into contact with the three-sectioned fork 35D, then fork 35D moves responsive to-the movement of the movable contact. Then the contact sections (35F, 35G and 35H) of the fork's tips move toward the corresponding fixed contacts (32A, 33A and 34A) responsive to the movement of the fork. The moving quantity of respective contact sections (35F, 35G and 35H) of the fork's tips is greater than that of the three-sectioned fork 35D.

In the operation discussed above, the area of top section 36A brought into contact with three-sectioned fork 35D is smaller than the total area of the plural fixed contacts (31A, 32A, 33A and 34A). However, top section 36A depresses three-sectioned fork 35D, so that respective contact sections of the tip of fork 35D keep contact with corresponding fixed contacts disposed on bottom face 30B in a stable manner.

The contact sections (35F, 35G and 35H) of the fork's tips can be arranged at given intervals. Therefore, the fixed contacts (32A, 33A and 34A) are arranged with given insulated spaces on bottom face 30B, and respective fixed contacts are kept electrically independent of each other. Further, arm 35E can be extended, so that the characteristics of service life with respect to the repeated depressions of the switch can be improved.

In the push switch in accordance with the first embodiment, domed movable contact 15 is brought into contact directly with the fixed contacts (11A, 12A, 13A and 14A) placed on bottom face 10B. Therefore, respective contacts are packed closely together, and are thus spaced with narrow intervals. On the other hand, the fixed contacts (32A, 33A, and 34A) of the second embodiment can be spaced at wider intervals than those in the first embodiment. As a result, the push switch in accordance with the second embodiment can be used at a relatively higher voltage.

Figure 9:
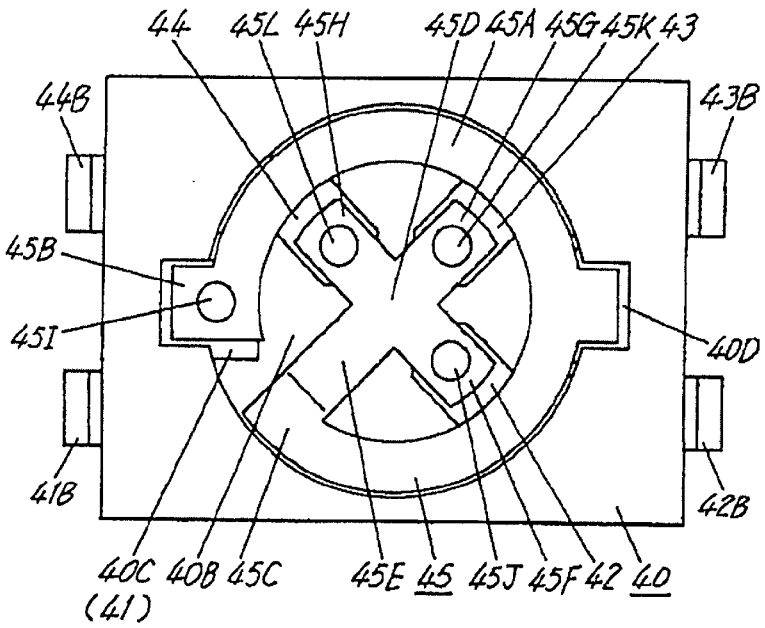
FIG. 9 is a plan view illustrating another form of the contact slip of the push switch in FIG. 6 housed in the switch housing.

FIG. 9 is a plan view of a switch housing accommodating another form of the contact slip shown in FIG. 6. A push switch shown in FIG. 9 comprises switch housing 40 of which the upper face open. Two contact-receptors 40C, 40D forming a step, face each other and are disposed on bottom face 40B of recess 40A of switch housing 40. This structure is the same as described in FIG. 6.

One contact-receptor 40C forming a step is selected from the group of contacts 41, 42, 43 and 44, and the selected fixed contact 41 is protrudedly formed. The remaining three contacts 42, 43 and 44 are disposed at the center of bottom face 40B. As in the first embodiment, respective fixed contacts 41, 42, 43 and 44 are electrically independent and conductive to respective coupling terminals 41B, 42B, 43B and 44B externally disposed of switch housing 40.

Outer rim 45A of contact slip 45 accommodated in recess 40A of switch housing 40 is approximately shaped as a donut, and a part of the donut is cut off. First end 45B of the cut-off section is placed on step-like contact-receptor 40C formed of fixed contact 41. Arm 45E extends from second end 45C toward the center of recess 40A upwardly in a moderate manner. Arm 45E couples with three-sectioned-fork 45D crossing at right angles at the center of recess 40A. End 45B and three-sectioned-fork's tips 45F, 45G and 45H have protruded contact sections 451, 45J, 45K and 45L respectively.

Domed movable contact 46 and flexible film 47 have the same structure as described in FIG. 6 and FIG. 7. The push switch structured as shown in FIG. 9 works the same as that described in FIG. 6 and FIG. 7. The push switch shown in FIG. 9 forms a switch by combining two random coupling terminals out of four extended from respective fixed electrically independent contacts. Further, these four terminals can be simultaneously turned on by one depressing. This action is the same as what has been done in the first embodiment.

According to the push-switch shown in FIG. 9, it is the three-sectioned fork of the contact slip that is deformed by depressing due to the deformation of the domed movable contact. A length between the contact receptor and the three sectioned fork can be longer than the bent portion of the contact slip described in FIG. 6 and FIG. 7. This structure allows the push switch shown in FIG. 9 to have an extended service life with respect to repeated depressions.

EXEMPLARY EMBODIMENT 3

Figure 10:
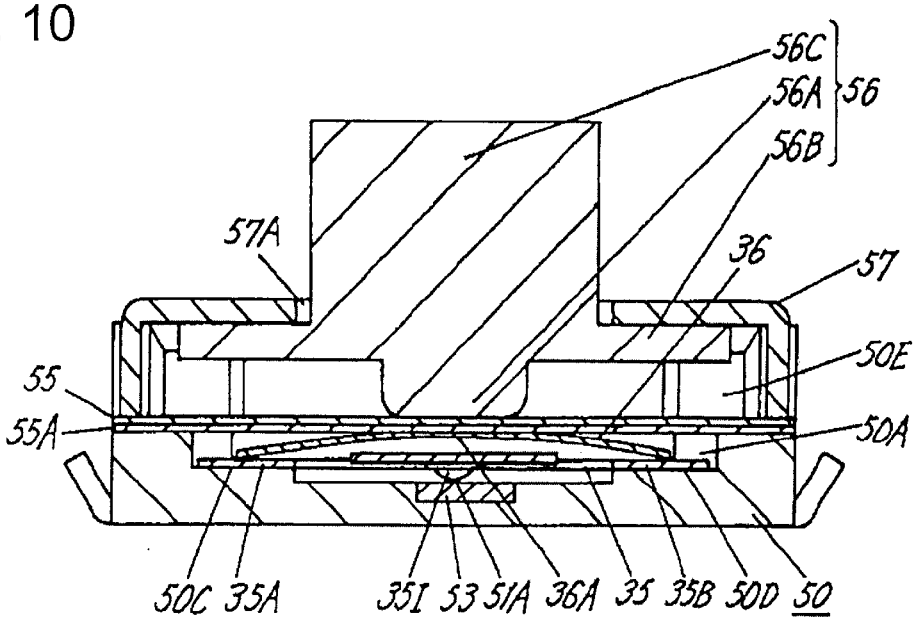
FIG. 10 is a front cross sectional view of a push switch in accordance with a third exemplary embodiment of the present invention.
Figure 11:
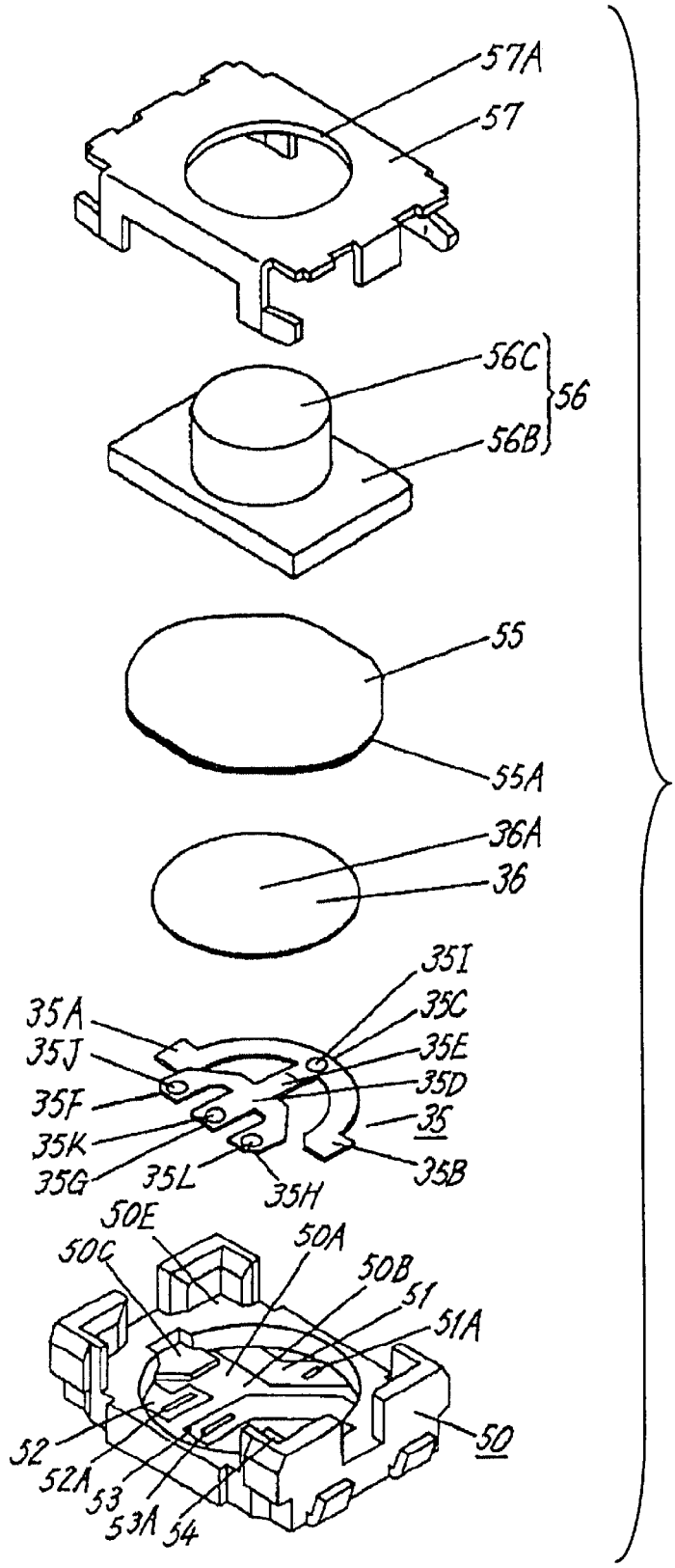
FIG. 11 is an exploded perspective view of the push switch shown in FIG. 10.

FIG. 10 is a front cross sectional view of a push switch in accordance with the third exemplary embodiment of the present invention. FIG. 11 is an exploded perspective view of the push switch shown in FIG. 10.

The opening of switch housing 50 of the third embodiment forms a step, i.e., recess 50A and recess 50E. Recess 50A (the opening of the first step) has the same structure as recess 30A of switch housing 30 shown in FIGS. 6 and 7 of the second embodiment. Recess 50A has a round shape and has four fixed contacts 51, 52, 53 and 54 electrically independent (i.e., not electrically connected) on bottom face 50B. Respective fixed contacts 51, 52, 53 and 54 have plural protruded contact sections 51A, 52A, 53A and 54A. Two contact-receptors 50C and 50D are provided at nooks on bottom face 50B. Recess 50A accommodates contact slip 35 and domed movable contact 36 in the same manner as in the second embodiment. Flexible film 55 having bonding agent 55A on its lower face is rigidly disposed on the upper face of the opening of the first step. Push-button 56 made of insulated resin is placed on recess 50E-an opening of the second step. Push-button 56 comprises flange 56B and operating section 56C having an upper section smaller than flange 56B. Flange 56B has protrusion 56A which depresses top 36A of domed movable contact 36.

Cover plate 57 is made of thin metal plate, and the metal is a rigid material such as stainless steel and has a hole 57A through which operating section 56C extends at the center. The cover plate 57 is mounted to switch housing 50. Cover plate 57 is provided so that it covers the entire opening of switch housing 50. As a result, push-button 56 is held ready to be depressed.

An operation of the push switch structured as discussed above is demonstrated hereinafter. First, push-button 56 is depressed downwardly so that protrusion 56A on the lower face pushes down top 36A of domed movable contact 36, so that contact 36 is deformed. When the deformed amount exceeds a given (predetermined) amount, domed movable contact 36 elastically deforms itself gradually and depresses down the three-sectioned fork 35D of arm 35E of contact slip 35 downwardly. This depression allows three contact sections 35J, 35K and 35L provided at tips 35F, 35G and 35H of fork 35D to contact corresponding contact sections 52A 53A and 54A of fixed contacts 52, 53 and 54 provided on bottom face 50B of switch housing 50. This contact allows respective fixed contacts 5l, 52, 53 and 54, which are electrically independent, to be simultaneously electrically connected to each other. This conductive operation is the same as that in the second embodiment.

According to the third embodiment, even if the push-button is depressed out of the operating center axis, the domed movable contact is depressed at a given spot due to the protrusion provided on the lower face of the push-button. Therefore, the push switch of the third embodiment advantageously has a stable operation tactile and stable contact.

EXEMPLARY EMBODIMENT 4

Figure 12:
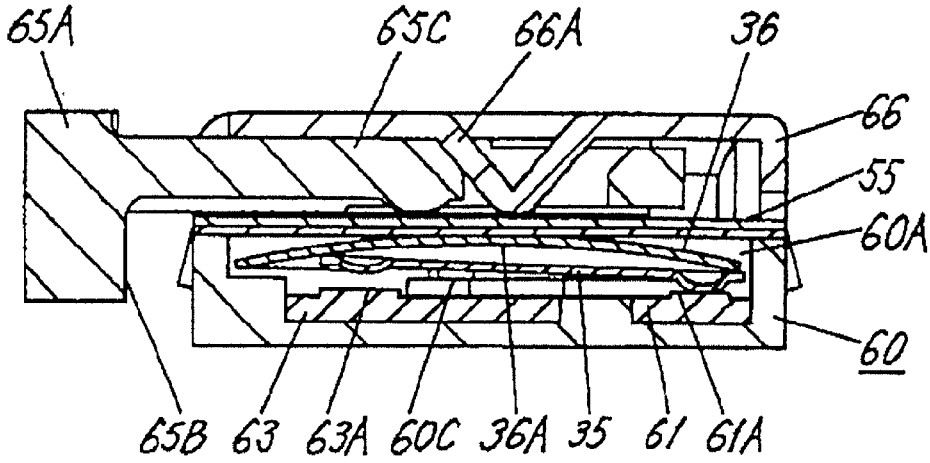
FIG. 12 is a lateral cross section of a push switch in accordance with a fourth exemplary embodiment of the present invention.
Figure 13:
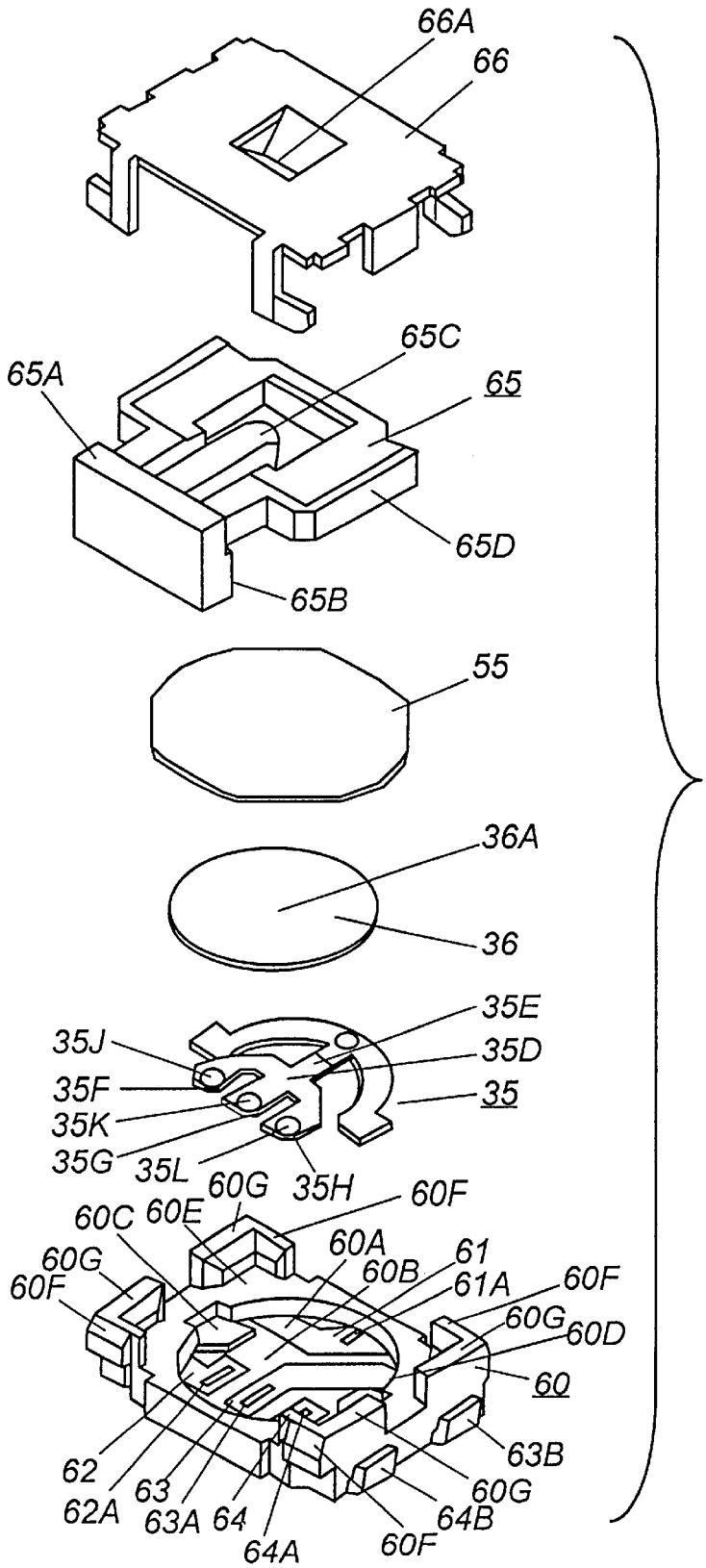
FIG. 13 is an exploded perspective view of the push switch shown in FIG. 12.
Figure 14:
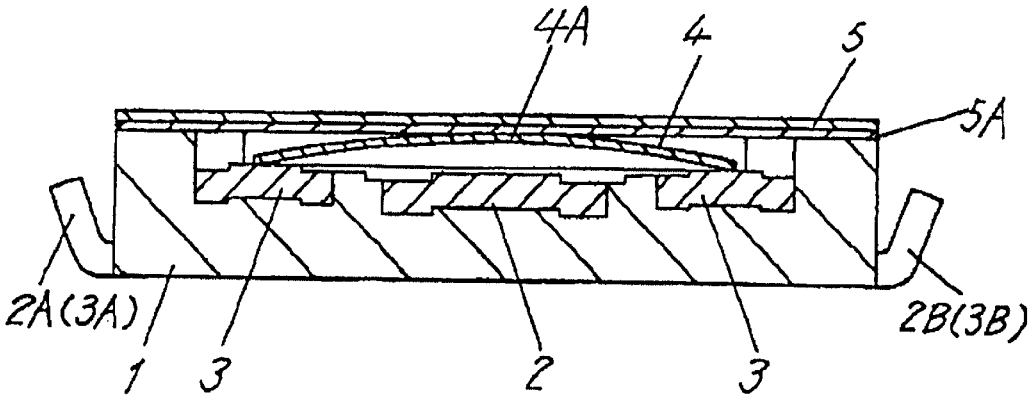
PRIOR ART FIG.14
FIG. 14 is a front cross sectional view of a conventional push switch.
Figure 15:
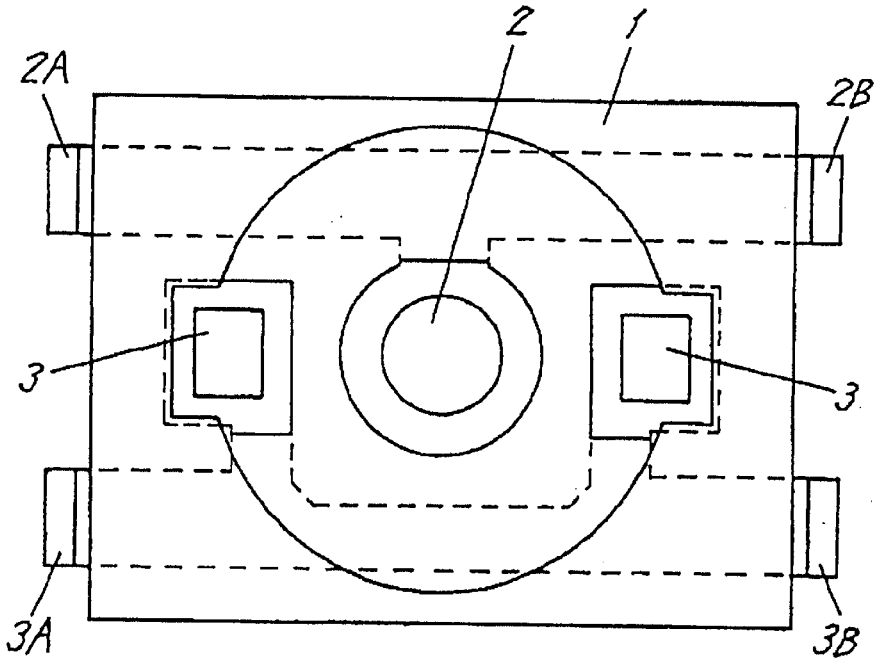
PRIOR ART FIG.15
FIG. 15 is a plan view of a switch housing illustrating fixed contacts of the conventional push switch shown in FIG. 14.

FIG. 12 is a lateral cross section of a push switch in accordance with the fourth exemplary embodiment of the present invention. FIG. 13 is an exploded perspective view of the push switch shown in FIG. 12.

The opening of switch housing 60 of the fourth embodiment forms a step, i.e., recess 60A and recess 60E. Recess 60A (the opening of the first step) has the same structure as recess 50A of switch housing 50 shown in FIGS. 10 and 11 of the third embodiment. Recess 60A has a round shape and has four fixed electrically independent contacts 61, 62, 63 and 64 on bottom face 60B. Upper faces of respective contacts 61, 62, 63 and 64 have plural protruded contact sections 61A, 62A, 63A and 64A. Two contact-receptors 60C and 60D are provided at nooks on bottom face 60B. Recess 60A accommodates contact slip 35 and domed movable contact 36, as in the third embodiment. Flexible film 55 having bonding agent 55A on its lower face is rigidly disposed on the upper face of the switch housing 60.

The first step of this fourth embodiment has the same structure as that of the third embodiment. Opening 60E of the second step shown in FIG. 13 is formed by four side-walls 60F and 60G shaped as "L" side-walls surrounding opening 60E. The four "L" shaped side-walls are formed on the upper face of first opening 60A, and push-button 65 made of insulated resin is provided in opening 60E of the second step. Push-button 65 is depressed in a lateral direction. Push-button 65 includes an operating section 65A to be depressed, tongue 65C extending from the center of face 65B opposite to the face of operating section 65A depressed toward the center of switch housing 60, and frame 65D surrounding tongue 65C.

Push-button 65 is placed such that operating section 65A protrudes between two "L" shaped side-walls forming opening 60E of the second step. Further, frame 65D of push-button 65 is arranged such that the frame slides with the inside of side-wall 60G of the "L" shaped side-wall.

Cover plate 66 is mounted to switch housing 60 so that plate 66 covers opening 60E of the second step where push-button 65 is placed. Cover plate 66 is made of thin metal plate having rigidity, such as stainless steel, and has a "V" shaped wedge 66A extending downwardly at the center. The slanted face of the wedge 66A is brought into contact with the tip of tongue 65C of push-button 65.

Next, an operation of the push switch structure discussed above is demonstrated hereinafter. First, operating section 65A of push-button 65 is depressed laterally, then frame 65D moves horizontally guided by side-wall 60G of switch housing 60. This movement allows the tip of tongue 65C of push-button 65 to be bent downwardly along the slanted face of wedge 66A of cover plate 66. This downward bending forces the tip of tongue 65C to push the top 36A of domed movable contact 36 just under flexible film 55.

Then this depressing force elastically deforms domed movable contact 36, and the lower face of top 36A of the contact depresses three-sectioned fork 35D of contact slip 35. Three contact sections 35J, 35K and 35L provided at the tips of fork 35D are brought into contact with corresponding contact sections 62A, 63A and 64A of the fixed contacts. These contacts allow respective fixed electrically independent contacts 62, 63 and 64 to be simultaneously electrically connected to each other. As a result, push switch 60 is turned on.

When the depressing force on operating section 65A of push-button 65 is removed, the elastic restoring force of domed movable contact 36 works. Therefore, the resultant of two restoring forces-elastic restoring force of movable contact 36 and restoring force of bending tongue 65C-works. As a result, tongue 65C returns to its original position along the slanted face of "V" shaped wedge 66A of cover plate 66, and domed movable contact 36 is restored to its original condition. Push-button 65 is pressed back to its original place, i.e., the position before it is depressed. Thus the switch is turned off.

According to the embodiments previously described, in addition to the advantages of the second and third embodiments, a simply structured and thin push switch can be obtained by making an operating direction parallel to the plane to which the push switch is mounted.

The "V" shaped wedge disposed at the center of the cover plate may only form a slant toward the switch center, and its shape can be formed by cutting, bending or combining other parts.

In the third and fourth embodiments, a flexible film is used in the description. However, in the push-button, the flexible film can be omitted, so that the number of materials used for the switch can be reduced.

In the second through the fourth embodiments, protruded contact sections provided on the upper faces of four fixed contacts are used in the description. However, recessed contact sections having a narrower width than that of the protruded contact sections can be used. In this case, multicontacts are prepared thanks to the combination of protrusions and recesses. As a result, stable contact can be expected.

Industrial Applicability

At least three fixed electrically independent contacts are prepared, and two random coupling terminals can have a switch function. Therefore, the push switch of the present invention provides great flexibility to engineers for designing a printed wiring board, and reduces restrictions for designing a compact and thin electronic device.

What is claimed is:

1. A push switch comprising:

a switch housing formed of insulating resin and having a recess;

at least four fixed contacts arranged on a bottom face of said recess so as to be electrically independent of each other;

a plurality of electrically independent coupling terminals, each of said coupling terminals being electrically connected to a respective one of said fixed contacts and extending outside of said switch housing;

a pair of contact-receptors formed on said bottom face of said recess so that each contact-receptor forms a step on said bottom face, and said contact-receptors being arranged so as to be separated from said fixed contacts;

a domed movable contact formed of elastic metal sheet, said domed movable contact being arranged in said recess such that a center of said movable contact protrudes upwardly;

a flexible cover rigidly mounted to said switch housing so as to cover said recess; and a contact slip arranged between said at least four fixed contacts and said domed movable contact, said contact slip being formed of elastic metal sheet and having a plurality of contact sections corresponding to said at least four fixed contacts;

wherein said contact slip and.said domed movable contact are arranged such that:

an outer rim of said contract slip is supported on said contact-receptors;

an outer rim of said domed movable contact is supported on said contact slip;

one of said contact sections of said contact slip permanently contacts a respective one of said fixed contacts, and a remaining group of said contact sections is operable to move between a non-contact position, whereat said remaining group of said contact sections do not electrically contact a remaining group of fixed contacts, and a contact position, whereat said remaining group of said contact sections electrically contact a remaining group of fixed contacts; and said domed movable contact is operable to push said remaining group of said contact sections from said non-contact position to said contact position so as to simultaneously electrically couple said remaining group of said contact sections and said remaining group of fixed contacts when said flexible cover is pushed against said domed movable contact.

2. The push switch of claim 1, wherein said fixed contacts protrude from said bottom face of said recess of said switch housing.

3. The push switch of claim 1, wherein each of said contact sections of said contact slip has a protrusion extending toward said bottom face of said recess, said contact sections being arranged so that each of said contact sections corresponds to a respective one of said fixed contacts.

4. The push switch of claim 1, wherein said domed movable contact has a protrusion extending toward said bottom face of said recess such that when said domed movable contact is pushed, said protrusion is brought into contact with said contact slip.

5. The push switch of claim 1, wherein each of said fixed contacts is integrally formed with a respective one of said coupling terminals from a metal sheet, and each of said fixed contacts and said coupling terminals is insert-molded with insulating resin to form said switch housing.

6. The push switch of claim 1, further comprising:

a push-button having an inner protrusion and being arranged on said flexible cover such that said inner protrusion presses against said flexible cover when said push-button is pushed, said flexible cover comprising a first cover; and a rigid second cover mounted to said switch housing and having a hole, said push-button having an outer protrusion and being arranged such that said outer protrusion is operable to move through said hole of said second cover.

7. The push switch of claim 6, wherein said fixed contacts protrude from said bottom face of said recess of said switch housing.

8. The push switch of claim 6, wherein each of said contact sections of said contact slip has a protrusion extending toward said bottom face of said recess, said contact sections being arranged so that each of said contact sections corresponds to a respective one of said fixed contacts.

9. The push switch of claim 6, wherein said domed movable contact has a protrusion extending toward said bottom face of said recess such that when said domed movable contact is pushed, said protrusion of said domed movable contact is brought into contact with said contact slip.

10. The push switch of claim 6, wherein each of said fixed contacts is integrally formed with a respective one of said coupling terminals from a metal sheet, and each of said fixed contacts and said coupling terminals is insert-molded with insulating resin to form said switch housing.

11. The push switch of claim 1, wherein said flexible cover comprises a first cover, said push switch further comprising:

a second cover formed of insulating resin, having a lateral recess on a side thereof, and having a bent section arranged in said lateral recess, said lateral recess having an opening; and a push-button for depressing said first cover, said push-button being mounted through said opening in said lateral recess of said second cover, and being operable to move through said opening, said bent section being arranged so as to guide a tip of said push-button downward when said push-button is pushed laterally such that said tip contacts said bent section.

12. The push switch of claim 11, wherein said fixed contacts protrude from said bottom face of said recess of said switch housing.

13. The push switch of claim 11, wherein each of said contact sections of said contact slip has a protrusion extending toward said bottom face of said recess of said switch housing, said contact sections being arranged so that each of said contact sections corresponds to a respective one of said fixed contacts.

14. The push switch of claim 11, wherein said domed movable contact has a protrusion extending toward said bottom face of said recess of said switch housing such that when said domed movable contact is pushed, said protrusion is brought into contact with said contact slip.

15. The push switch of claim 11, wherein each of said fixed contacts is integrally formed with a respective one of said coupling terminals from a metal sheet, and each of said fixed contact and said coupling terminals is insert-molded with insulating resin to form said switch housing.

* * * * *